US007382095B2

(12) United States Patent
Kang et al.

(10) Patent No.: US 7,382,095 B2
(45) Date of Patent: Jun. 3, 2008

(54) PDP PROVIDED WITH GREEN PHOSPHOR LAYER HAVING A HEIGHT DIFFERENCE IN RELATION TO RED/BLUE PHOSPHOR LAYERS AND CORRESPONDING BARRIER RIBS

(75) Inventors: Tae-Kyoung Kang, Suwon-si (KR); Jae-Ik Kwon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 207 days.

(21) Appl. No.: 11/128,358

(22) Filed: May 13, 2005

(65) Prior Publication Data

US 2005/0264210 A1 Dec. 1, 2005

(30) Foreign Application Priority Data

May 28, 2004 (KR) ..... 10-2004-0038183

(51) Int. Cl.
*H01J 17/49* (2006.01)

(52) U.S. Cl. ..... 313/582; 313/586; 313/587; 313/485

(58) Field of Classification Search ..... 313/581–587, 313/483–487, 292
See application file for complete search history.

(56) References Cited

U.S. PATENT DOCUMENTS

| | | | | |
|---|---|---|---|---|
| 6,420,835 | B1 * | 7/2002 | Chen et al. | 315/169.4 |
| 6,611,099 | B1 * | 8/2003 | Murata et al. | 313/582 |
| 6,713,959 | B1 * | 3/2004 | Toyoda et al. | 313/582 |
| 2001/0003410 | A1 * | 6/2001 | Haruki et al. | 313/585 |
| 2002/0195936 | A1 * | 12/2002 | Kato et al. | 313/582 |
| 2005/0088090 | A1 * | 4/2005 | Wu et al. | 313/582 |

FOREIGN PATENT DOCUMENTS

| | | | |
|---|---|---|---|
| JP | 06267432 | A * | 9/1994 |
| JP | 10247458 | A * | 9/1998 |
| JP | 2000123749 | A * | 4/2000 |
| JP | 2001-236893 | | 8/2001 |

* cited by examiner

*Primary Examiner*—Maricelli Santiago
(74) *Attorney, Agent, or Firm*—H.C. Park & Associates, PLC

(57) ABSTRACT

A PDP includes a barrier rib formed between an upper substrate and a lower substrate to define discharge regions, and a phosphor layer including red, green, and blue phosphor layers corresponding to the discharge regions. A height of the green phosphor layer is lower than a height of the barrier rib.

16 Claims, 4 Drawing Sheets

PDP PROVIDED WITH GREEN PHOSPHOR LAYER HAVING A HEIGHT DIFFERENCE IN RELATION TO RED/BLUE PHOSPHOR LAYERS AND CORRESPONDING BARRIER RIBS

CROSS REFERENCE TO RELATED APPLICATION

This application claims priority to and the benefit of Korean Patent Application No. 10-2004-0038183, filed on May 28, 2004, which is hereby incorporated by reference for all purposes as if fully set forth herein.

BACKGROUND OF THE INVENTION

1. Field of the Invention

The present invention relates to a plasma display panel (PDP), and more particularly, a PDP having an improved structure that may provide a high level of discharge stability.

2. Discussion of the Background

Generally, in a PDP, applying a predetermined voltage to electrodes having a gas filled between them generates a glow discharge, which generates ultraviolet rays that excite a phosphor layer to emit light, thereby displaying an image.

PDPs can be classified as direct current (DC) PDPs, alternating current (AC) PDPs, or hybrid PDPs according to their driving methods. A PDP can also be classified as a two-electrode type or a three-electrode type according to the number of electrodes. A DC PDP includes an auxiliary electrode to induce an auxiliary discharge, and an AC PDP includes an address electrode for improving addressing speed by separating an address discharge and a sustain discharge. Also, the AC PDP can be classified as an opposing discharge type and a surface discharge type according to discharge electrode arrangement. The opposing discharge type may include two sustain electrodes disposed on two substrates, respectively, to generate a discharge perpendicularly to the panel, and the surface discharge type may include two sustain electrodes disposed on one substrate to generate the discharge on a surface of the substrate.

FIG. 1 is a perspective view of a conventional surface discharge AC PDP.

The PDP 10 includes an upper substrate 11 and a lower substrate 21 facing the upper substrate 11 and substantially parallel to the upper substrate 11.

A sustain electrode pair 12 includes a common electrode 13 and a scan electrode 14, which are formed on a lower surface of the upper substrate 11. A discharge gap separates the common electrode 13 from the scan electrode 14.

The common electrode 13 and the scan electrode 14 include transparent electrodes 13*a* and 14*a* and bus electrodes 13*b* and 14*b*, respectively. The bus electrodes 13*b* and 14*b* may be formed along edges of the transparent electrodes 13*a* and 14*a* to apply voltages to the transparent electrodes 13*a* and 14*a*. An upper dielectric layer 15 covers the sustain electrode pairs 12, and a protective layer 16 covers the upper dielectric layer 15.

Additionally, address electrodes 22 may be formed on a surface of the lower substrate 21 facing the uppers substrate 11 and substantially perpendicular to the sustain electrode pairs 12. Areas where the address electrodes 22 and the sustain electrode pairs 12 cross each other become unit discharge cells (i.e. sub-pixels).

A lower dielectric layer 23 covers the address electrodes 22. Stripe-shaped barrier ribs 24 may be formed on the lower dielectric layer 23 to define discharge regions 25. A phosphor layer 26 is formed in the discharge regions 25, and a discharge gas is filled in the discharge regions 25. The phosphor layer 26 may include red, green, and blue phosphor layers 26R, 26G, and 26B according to the color of light the phosphor materials emit.

A PDP having the above structure may operate as follows.

Applying an address discharge voltage between an address electrode 22 and a scan electrode 14 generates an address discharge, which forms wall charges in the addressed discharge cell. Next, applying a sustain discharge voltage between the common electrode 13 and the scan electrode 14 of the addressed discharge cell generates a sustain discharge. Charges generated by the sustain discharge collide into the discharge gas, thereby forming plasma, which generates ultraviolet rays. The ultraviolet rays excite the phosphor layer 26, thereby displaying an image on the panel.

As FIG. 2 shows, the red, green, and blue phosphor layers 26R, 26G, and 26B may have the same height h as the barrier ribs h2. Here, the height h1 of the phosphor layer 26 is a straight distance between a lower surface of the barrier rib 24 and a highest point to which the phosphor layer 26 extends, and the height h2 of the barrier rib 24 is a straight distance between the lower surface of the barrier rib 24 and an upper surface of the barrier rib 24.

Typically used red and blue phosphor materials have positive polarities, while the green phosphor material typically has a negative polarity. If the red, green, and blue phosphor is layers have the same height as the barrier ribs, the address voltage for the green phosphor layer may be higher than for the red and blue phosphor layers. In order to solve this problem, Japanese Laid-open Patent No. 2001-236893 discloses a PDP in which negative polarity green phosphor material is mixed with positive polarity green phosphor material to change the phosphor material's polarity. However, changing the green phosphor material's polarity may change the address discharge characteristics, which may affect the following sustain discharge. Therefore, it is desirable to design a green phosphor layer that is capable of obtaining a stable sustain discharge.

SUMMARY OF THE INVENTION

The present invention provides a PDP that may have more stable discharge characteristics by forming a green phosphor layer lower than a barrier rib.

Additional features of the invention will be set forth in the description which follows, and in part will be apparent from the description, or may be learned by practice of the invention.

The present invention discloses a PDP including a barrier rib formed between an upper substrate and a lower substrate to define discharge regions, and a phosphor layer including red, green, and blue phosphor layers corresponding to the discharge regions. A height of the green phosphor layer is lower than a height of the barrier rib.

The present invention also discloses an upper substrate, a lower substrate facing the upper substrate, barrier ribs formed between the upper substrate and the lower substrate to define discharge regions, and a red phosphor layer, a green phosphor layer, and a blue phosphor layer formed in corresponding discharge regions. A height of the green phosphor layer differs from at least one of a height of the red phosphor layer or a height of the blue phosphor layer.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
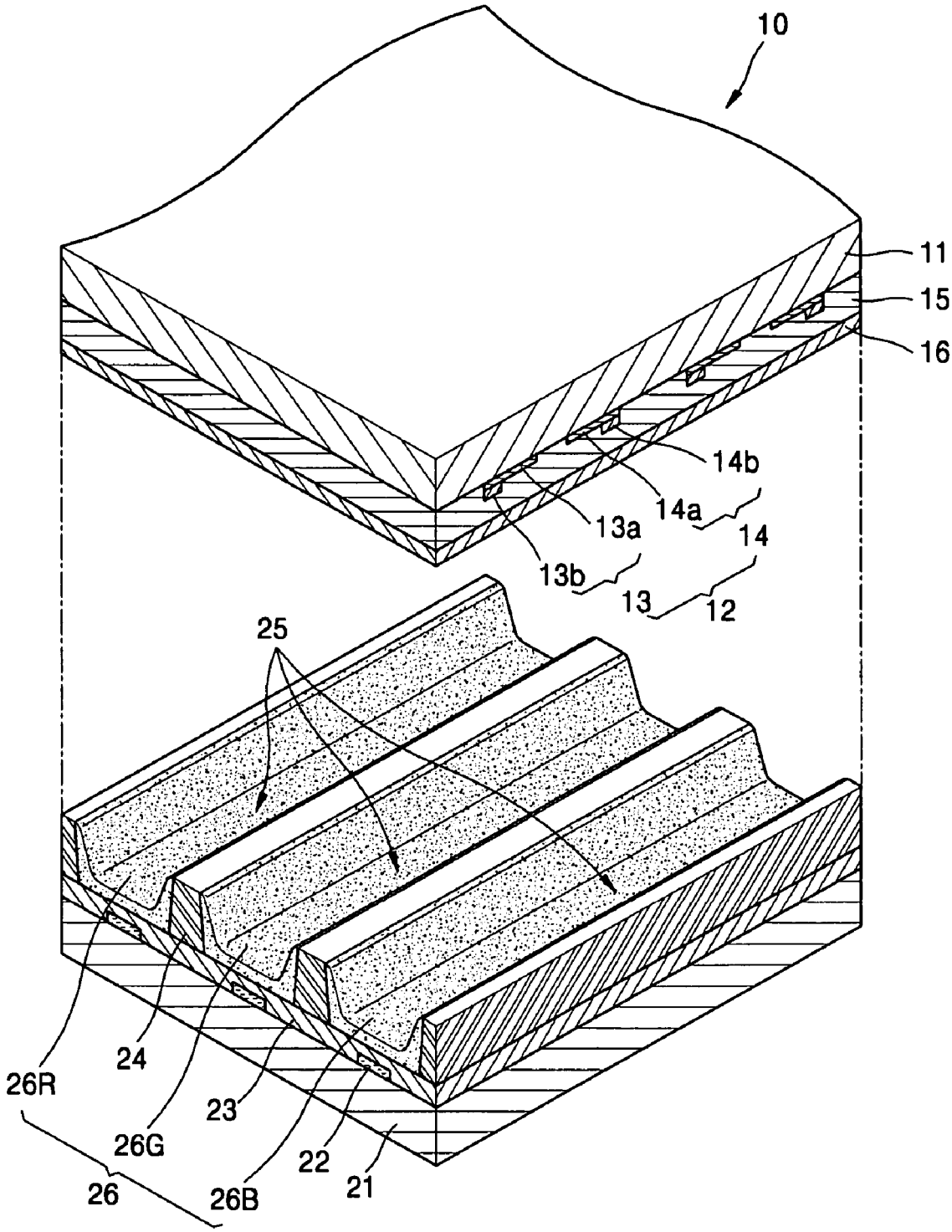
FIG. 1 (PRIOR ART)
FIG. 1 is a perspective view showing a conventional PDP.
Figure 2:
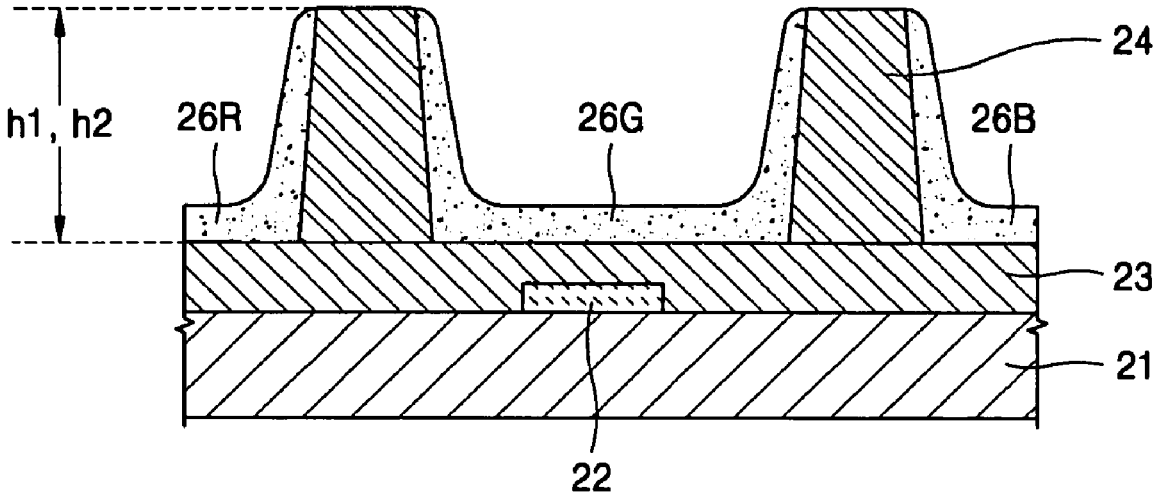
FIG. 2 (PRIOR ART)
FIG. 2 is a partial cross-sectional view showing red, green and blue phosphor layers formed on barrier ribs of the PDP of FIG. 1.
Figure 3:
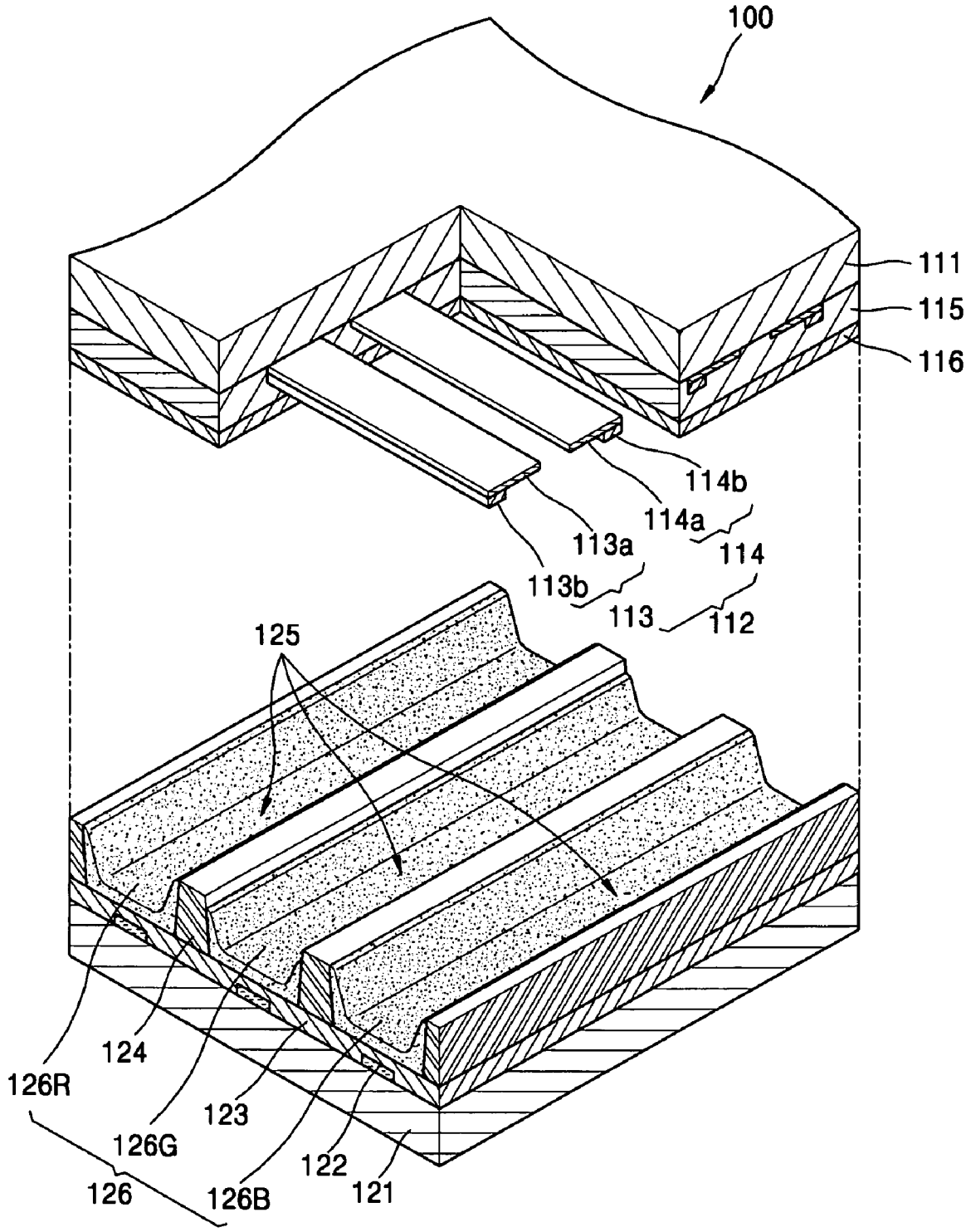
FIG. 3 is a perspective view showing a PDP according to an exemplary embodiment of the present invention.

FIG. 3 is a perspective view showing a PDP according to an exemplary embodiment of the present invention.

Referring to FIG. 3, the PDP 100 may include an upper substrate 111 and a lower substrate 121 facing the upper substrate 111.

The upper substrate 111 may be formed of a transparent material, such as, for example, glass so that light may transmit through it. A plurality of sustain electrode pairs 112 may be arranged on a surface of the upper substrate 111 facing the lower substrate 121. The sustain electrode pairs 112 may include a common electrode 113 and a scan electrode 114.

The common electrode 113 and the scan electrode 114 may include transparent electrodes 113*a* and 114*a* and bus electrodes 113*b* and 114*b*, respectively. The bus electrodes 113*b* and 114*b* may be connected to edges of the transparent electrodes 113*a* and 114*a*. Here, the transparent electrodes 113*a* and 114*a* are formed as strips, and the bus electrodes 113*b* and 114*b* are narrower than the transparent electrodes 113*a* and 114*a*. Additionally, a discharge gap separates the transparent electrodes 113*a* and 114*a* from each other, and the bus electrodes 1113*b* and 114*b* are disposed at opposite sides of the discharge gap.

The transparent electrodes 113*a* and 114*a* may be formed of a transparent conductive material, such as, for example, indium tin oxide (ITO) so that they may transmit visible light. Additionally, the bus electrodes 113*b* and 114*b*, which apply voltages to the transparent electrodes 113*a* and 114*a*, may be formed of a highly conductive metal, such as, for example, Ag or Cu in order to enhance the conductivity of the transparent electrodes 113*a* and 114*a*. While FIG. 3 shows the transparent electrodes 113*a* and 114*a* formed as strips, they may have various configurations. Further, the common electrode and the scan electrode may include transparent electrodes only or bus electrodes only. An upper dielectric layer 115 covers the sustain electrode pairs 112, and a protective layer 116, which may be formed of magnesium is oxide (MgO), may cover the upper dielectric layer 115.

Address electrodes 122 may be formed on the surface of the lower substrate 121 facing the upper substrate 111 and in a direction substantially orthogonal to the sustain electrode pairs 112. The address electrodes 122 may be arranged in a stripe pattern, and a lower dielectric layer 123 covers the address electrodes 122. Areas where the address electrodes 122 and the sustain electrode pairs 112 cross each other correspond to unit discharge cells (i.e. sub-pixels).

Stripe-shaped barrier ribs 124 may be formed on the lower dielectric layer 123 to define the discharge regions 125 between the upper and lower substrates 111 and 121. The barrier ribs 124 may prevent cross talk between adjacent discharge regions 125. The barrier ribs 124 may be disposed in between, and parallel to, the address electrodes 122. The barrier ribs may have various configurations, including, for example, a matrix or delta configuration.

A phosphor layer 126 may be disposed in the discharge regions 125. The phosphor layer 126, which is made of red, green, and blue phosphor materials, includes a red phosphor layer 126R, a green phosphor layer 126G, and a blue phosphor layer 126B according to the color of light emitted by the phosphor materials. The red, green, and blue phosphor layers 126R, 126G, and 126B form a set and are arranged adjacent to each other to generate desired colors.

A discharge gas, which may comprise a mixture of Ne and Xe, is filled in the discharge regions 125, and the upper and lower substrates 111 and 121 are sealed together by a sealing member such as a frit glass formed along edges of the upper and lower substrates 111 and 121.

Figure 5:
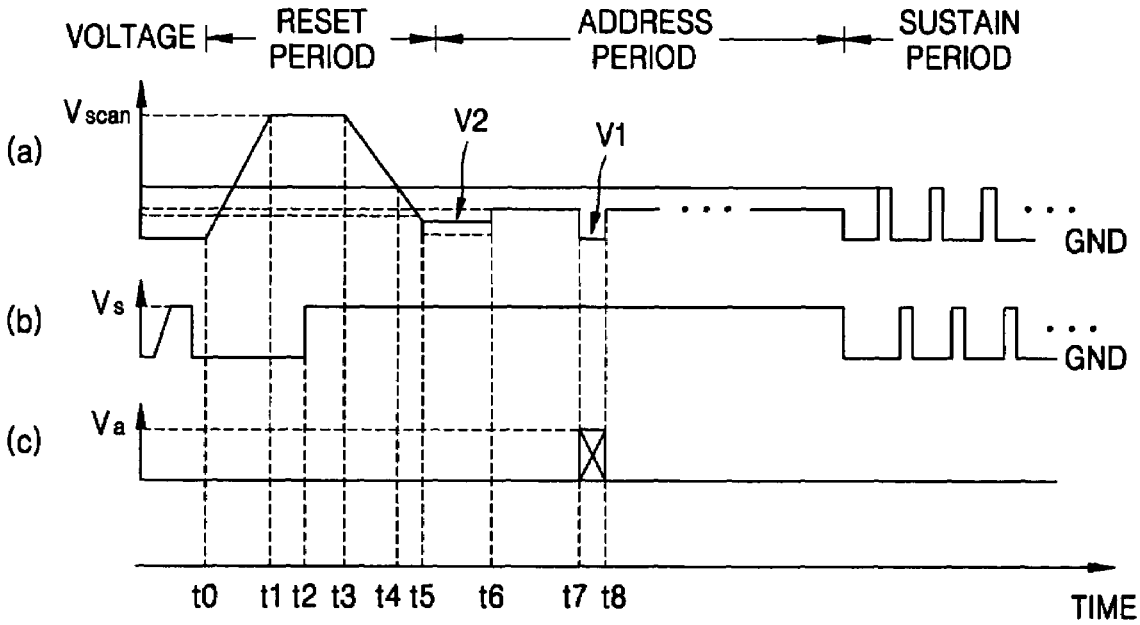
FIG. 5 is a waveform diagram showing driving voltages that may be applied to a scan electrode, a common electrode, and an address electrode in the PDP according to an exemplary embodiment of the present invention.

Referring to FIG. 5, driving waveforms may be applied in a reset period, an address period, and a sustain period. The driving waveform Vscan may be applied to the scan electrodes 114, the driving waveform Vs may be applied to the common electrodes 113, and the driving waveform Va may be applied to the address electrodes 122 to operate the PDP 100.

A reset discharge for initializing wall charges of the discharge regions 125 occurs during the reset period, an address discharge for accumulating wall charges in the discharge regions 125 occurs during the address period, and a sustain discharge occurs during the sustain period. The sustain discharge causes the discharge gas to generate plasma, which generates ultraviolet rays that excite the phosphor layer 126 to emit light.

For example, the red phosphor layer may be formed of $(Y,Gd)BO_3$:Eu, the green phosphor layer may be formed of $Zn_2SiO_4$:Mn, and the blue phosphor layer may be formed of $BaMgAl_{10}O_{17}$:Eu.

Here, the red and blue phosphor materials noted above have positive polarities having positive charges, but the green phosphor material has a negative polarity having negative charges. When the green phosphor layer has negative polarity, a higher address voltage may be required for the green phosphor layer than for the red and blue phosphor layers.

Moreover, since the green phosphor layer may have different discharge characteristics than the red and blue phosphor layers, a mis-discharge or irregular discharge may occur with the green phosphor layer, which may make it difficult to obtain discharge stability.

Figure 4:
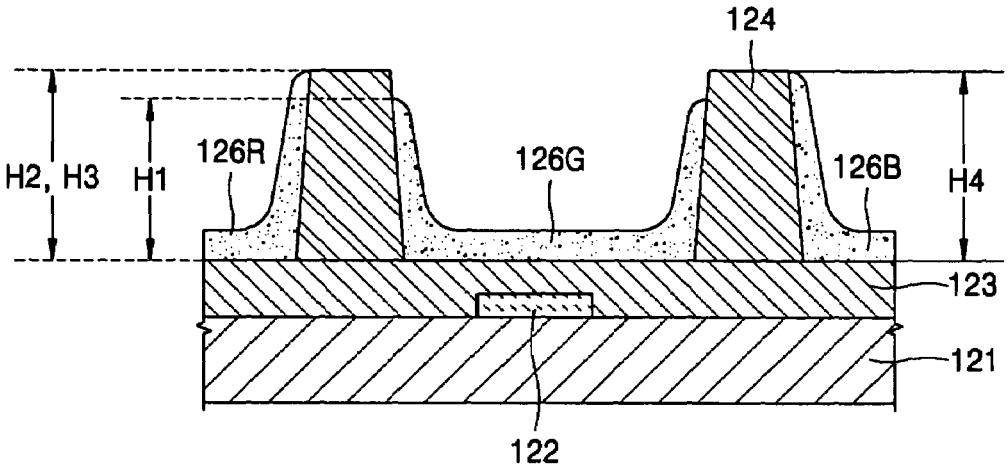
FIG. 4 is a partial cross-sectional view showing red, green and blue phosphor layers formed on barrier ribs of the PDP of FIG. 3.

Therefore, according to an exemplary embodiment of the present invention, the green phosphor layer 126G may be formed including green phosphor material that has positive polarity, and the green phosphor layer 126G may be lower than the barrier ribs 124. Referring to FIG. 4, the height H1 of the green phosphor layer 126G is a distance from a lower surface of the barrier ribs 124 perpendicularly to a highest point to which the green phosphor layer 126G extends, and the height H2 of the barrier ribs 124 is a distance from the lower surface of the is barrier rib 124 perpendicularly to the upper surface of the barrier rib 124. A height H3 of the red phosphor layer 126R and a height H4' of the blue phosphor layer 126B may equal the height H2 of the barrier ribs 124, however, these are not limited thereto.

The green phosphor layer 126G may be formed by mixing the green phosphor material having negative polarity, (i.e. $Zn_2SiO_4$:Mn) with green phosphor material having positive polarity, such as, for example $YBO_3$:Tb. Additionally, the positive green phosphor material may comprise about 50% to 60% of the mixture.

If conventional driving waveforms are applied to a PDP having the above green phosphor layer 126G formed including the green phosphor material having positive polarity, the address discharge may easily occur, but an excess sustain discharge may also occur after the address discharge.

Specifically, referring to the driving waveform Vscan of FIG. 5, if a reset termination potential V2 in the reset period is higher than a scan low level potential V1 in the address period, the possibility of generating an excess sustain discharge increases. Forming the green phosphor layer 126G lower than the barrier ribs 124 may solve this problem.

However, if the height H1 of the green phosphor layer 126G is much lower than the height H2 of the barrier ribs 124, a low discharge may occur. Thus, a ratio between the height H1 of the green phosphor layer 126G and the height H2 of the barrier ribs 124 should be set appropriately so that the discharge can more stably occur.

The ratio between the heights H1 and H2 can be set based on the experimental data of Table 1.

Table 1 shows the correlation between the height H2 of the barrier ribs 124 and the height H1 of the green phosphor layer 126G and a ratio of generating a mis-discharge according to differences between the reset termination potential V2 and the scan low level potential V1. Here, the ratio of generating the mis-discharge is a ratio of generating the excess discharge or a ratio of generating the low-discharge. Additionally, (H2−H1)/H2×100 is (height of the barrier rib—height of green phosphor layer)/height of the barrier rib×100, and V2−V1 is the reset termination potential minus the scan low level potential. Further, the green phosphor layer includes a mixture of the green phosphor material having positive polarity and the green phosphor material having negative polarity in a 1:1 ratio.

TABLE 1

| | | V2-V1(V) | | | | |
|---|---|---|---|---|---|---|
| | | 0 | 5 | 10 | 15 | 20 |
| (H2-H1)/H2 × 100(%) | 0 | 100 | 100 | 100 | 100 | 100 |
| | 1 | 50 | 50 | 60 | 70 | 70 |
| | 2 | 0 | 0 | 0 | 0 | 0 |
| | 3 | 0 | 0 | 0 | 0 | 0 |
| | 4 | 0 | 0 | 0 | 0 | 0 |
| | 5 | 0 | 0 | 0 | 0 | 0 |
| | 6 | 0 | 0 | 0 | 0 | 0 |
| | 7 | 0 | 0 | 0 | 0 | 0 |
| | 8 | 0 | 0 | 0 | 0 | 0 |
| | 9 | 0 | 0 | 0 | 0 | 0 |
| | 10 | 0 | 0 | 0 | 0 | 0 |
| | 11 | 0 | 0 | 0 | 0 | 0 |
| | 12 | 0 | 0 | 0 | 0 | 0 |
| | 13 | 0 | 0 | 0 | 0 | 0 |
| | 14 | 0 | 0 | 0 | 0 | 0 |
| | 15 | 0 | 0 | 0 | 0 | 0 |
| | 16 | 0 | 0 | 0 | 0 | 0 |
| | 17 | 0 | 0 | 0 | 0 | 0 |
| | 18 | 0 | 0 | 0 | 0 | 0 |
| | 19 | 0 | 0 | 0 | 0 | 0 |
| | 20 | 0 | 0 | 0 | 0 | 0 |
| | 21 | 20 | 20 | 10 | 10 | 10 |
| | 22 | 50 | 50 | 30 | 30 | 20 |
| | 23 | 90 | 90 | 70 | 80 | 80 |
| | 24 | 100 | 100 | 100 | 90 | 90 |

Referring to Table 1, when V2−V1 is 0V, mis-discharge may occur when (H2−H1)/H2×100 is 0 to 1% and 21 to 24%. Additionally, when V2−V1 is 5, 10, 15, and 20V, mis-discharge may also occur when (H2−H1)/H2×100 is 0 to 1% and 21 to 24%. The excess discharge may also occur when (H2−H1)/H2×100 is 0 to 1%, and the low discharge may occur when (H2−H1)/H2×100 is 21 to 24%. Accordingly, as the difference between the height of the green phosphor layer 126H (H1) and the height of the barrier rib 124 (H2) decreases, the ratio of generating the excess discharge increases, and as the difference between the height of the green phosphor layer 126G (H1) and the height of the barrier rib 124 (H2) increases, the ratio of generating the low discharge increases. Consequently, when (H2−H1)/H2×100 is 2% to 20%, a stable discharge can be performed even when V2−V1 rises from 0V to 20V.

Therefore, (H2−H1)/H2×100 can be set to be 2% to 20% based on the above experimental results. Furthermore, within the set range, the reset termination potential can be 20V higher than the scan low level potential. Thus, the address voltage can be reduced.

As described above, the green phosphor layer may be formed by mixing green phosphor material having negative polarity with green phosphor material having positive polarity, and the green phosphor layer may be formed lower than the barrier rib. Therefore, the address voltage can be lowered, and stability of the discharge operation can be obtained.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (POP), comprising:

an upper substrate;

a lower substrate facing the upper substrate;

a barrier rib formed between the upper substrate and the lower substrate to define discharge regions; and a phosphor layer including a red phosphor layer, a green phosphor layer, and a blue phosphor layer in respective discharge regions, wherein a height of the green phosphor layer is lower than a height of the barrier rib, and a height of the blue phosphor layer and a height of the red phosphor layer are both equal to the height of the barrier rib.

2. The PDP of claim 1, wherein the upper substrate comprises a plurality of sustain electrode pairs including a common electrode and a scan electrode covered by an upper dielectric layer, and the lower substrate comprises address electrodes covered by a lower dielectric layer and formed in a direction crossing the sustain electrode pairs.

3. The PDP of claim 2, wherein a driving waveform is applied to the scan electrode in a reset period, an address period, and a sustain period, and the driving waveform has a reset termination potential in the reset period that is higher than a scan low level potential in the address period.

4. The PDP of claim 2, further comprising a protective layer covering the upper dielectric layer.

5. The PDP of claim 1, wherein (H2−H1)/H2×100 is at least 2% when H1 is the height of the green phosphor layer and H2 is the height of the barrier rib.

6. The PDP of claim 5, wherein (H2−H1)/H2×100 is in a range of 2% to 20%.

7. The PDP of claim 1, wherein the green phosphor layer comprises a green phosphor material having a negative polarity and a green phosphor material having a positive polarity.

8. The PDP of claim 7, wherein the green phosphor material having the negative polarity is $Zn_2SiO_4$:Mn and the green phosphor material having the positive polarity is $YBO_3$:Tb.

9. The PDP of claim 8, wherein an amount of $YBO_3$:Tb is greater than or equal to an amount of $Zn_2SiO_4$:Mn.

10. A plasma display panel, comprising:

an upper substrate;

a lower substrate facing the upper substrate;

barrier ribs formed between the upper substrate and the lower substrate to define discharge regions; and a red phosphor layer, a green phosphor layer, and a blue phosphor layer formed in respective discharge regions, wherein a height of the green phosphor layer differs from a height of the red phosphor layer and a height of the blue phosphor layer, the height of the red phosphor layer being equal to the height of the blue phosphor layer.

11. The PDP of claim 10, wherein the height of the green phosphor layer is less than the height of the red phosphor layer and the blue phosphor layer.

12. The PDP of claim 10, wherein (H2−H1)/H2×100 is at least 2% when H1 is the height of the green phosphor layer and H2 is a height of a barrier rib.

13. The PDP of claim 12, wherein (H2−H1)/H2×100 is in a range of 2% to 20%.

14. The PDP of claim 10, wherein the green phosphor layer comprises a green phosphor material having a negative polarity and a green phosphor material having a positive polarity.

15. The PDP of claim 14, wherein the green phosphor material having the negative polarity is $Zn_2SiO_4$:Mn and the green phosphor material having the positive polarity is $YBO_3$:Tb.

16. The PDP of claim 15, wherein an amount of $YBO_3$:Tb is greater than or equal to an amount of $Zn_2SiO_4$:Mn.

* * * * *